United States Patent [19]

Warkentin et al.

[11] 4,329,831

[45] May 18, 1982

[54] APPARATUS FOR PACKING ARTICLES OF FRUIT INTO BOXES

[75] Inventors: Aaron J. Warkentin, Orange Cove; Jacob Hiebert, Reedley, both of Calif.

[73] Assignee: Pennwalt Corporation, Philadelphia, Pa.

[21] Appl. No.: 146,995

[22] Filed: May 5, 1980

[51] Int. Cl.[3] ..... B65B 5/10

[52] U.S. Cl. ..... 53/537; 53/240; 53/244; 53/245; 53/247

[58] Field of Search ..... 53/535, 537, 251, 240, 53/245, 247, 538, 543, 149, 150, 255, 494, 495, 244

[56] References Cited

U.S. PATENT DOCUMENTS

| | | | |
|---|---|---|---|
| 2,179,648 | 11/1939 | Thayer | 53/251 X |
| 2,827,082 | 3/1958 | Baum | 53/245 X |
| 2,896,384 | 7/1959 | Carlsen et al. | 53/245 X |
| 3,292,341 | 12/1966 | Frost | 53/538 X |
| 3,338,009 | 8/1967 | Stevens | 53/247 X |
| 3,388,527 | 6/1968 | Vadas | 53/247 |
| 3,420,038 | 1/1969 | Crabb | 53/245 X |
| 3,465,495 | 9/1969 | Zwiacher et al. | 53/537 |
| 3,492,779 | 2/1970 | Russell | 53/245 |
| 4,203,274 | 5/1980 | Warkentin et al. | 53/543 X |

*Primary Examiner*—Horace M. Culver

[57] ABSTRACT

Apparatus for automatically, rapidly, and simultaneously packing multiple layers of fruit, such as cantaloupes, for example, into packing boxes wherein the layers of fruit are packed in a predetermined staggered or complementary pattern. A pair of packing heads, i.e., a first packing head and a second packing head, in near side-by-side relationship, are automatically simultaneously tilted, in response to like mechanisms or actuators, to deposit the fruit which are automatically prearranged thereon in a predetermined pattern into indexed packing boxes. The second packing head which packs the top layer of fruit is set back slightly from the first packing head which packs the first or bottom layer of fruit thus allowing the second packing head to place its fruit onto the bottom layer. The container is then automatically moved forward in order that the next cycle can take place. Structure providing this unique arrangement is described.

16 Claims, 11 Drawing Figures

APPARATUS FOR PACKING ARTICLES OF FRUIT INTO BOXES

CROSS-REFERENCE TO RELATED PATENT APPLICATIONS

Reference is hereby made to copending patent application Ser. No. 858,821, filed Dec. 8, 1977, for "Apparatus for Packing Articles of Fruit Into Boxes", and now U.S. Pat. No. 4,203,274, same inventors and assigned to the present assignee.

STATEMENT OF THE INVENTION

This invention relates to the packing of fruit and more particularly to compact automated apparatus for simultaneously packing layers of fruit in predetermined patterns into packing boxes.

BACKGROUND OF THE INVENTION

Certain fruits, such as melons, must be securely packed in shipping containers to prevent damage during transit and handling. To achieve this result, the articles of fruit are snugly packed into predetermined patterns. Typically, staggered or alternating patterns are used. For example, a shipping box could contain two layers of melons with each layer having nine melons. The bottom layer would consist of three rows of three melons each with the center row offset so that the melons in the center row fit snugly against the melons in the side rows in a staggered pattern. The side rows, in turn, fit snugly against the sides of the box holding the layer of melons securely in place. A second layer of melons could be packed in a complementary staggered pattern so that the melons in the second layer would fit snugly against each other and the melons in the first layer. Additional alternating staggered layers of melons could be added depending upon how many melons are to be packed in a box.

An additional advantage of packing melons in staggered alternating layers enables more melons to be packed in a container than could be packed if random packing patterns are used. The pattern pack is standard in the industry. The rough texture of cantaloupes prevents nesting thereof by loose filling methods.

Packing fruit by hand is expensive. The apparatus, which is the subject of the present invention, relates to a compact labor-saving and cost-saving automated device which rapidly and simultaneously packs layers of fruit in predetermined patterns.

SUMMARY AND ADVANTAGES OF THE INVENTION

Articles of fruit are fed onto an upwardly inclined conveyor belt in a direction opposing its direction of travel to thereby spread the fruit and prevent their lodging, and are received by a declined feeder-packing head which cooperates with fruit retaining means which sequentially releases the fruit fed to the feeder onto the packing head such that the fruit becomes arranged thereon in a prearranged or staggered pattern.

The packing head is pivotable about its lower portion. The fruit, as arranged on the packing head, is thus pivotally ejectable into a packing box resting upon and carried by a movable L-shaped table assembly which simultaneously brings the box towards the pivoting packing head to cause the fruit to be packed as a bottom or first layer in the box in the exact prearranged staggered pattern as arranged on the packing head.

Another, or upper feeder-packing head, operates in substantial unison therewith to pack a second or top layer of fruit in nesting relationship to the first layer. The fruit will be automatically arranged on the packing head of the upper feeder-packing head in a pattern which complements the pattern of the first layer of fruit. The upper feeder-packing head is disposed a distance above the lower feeder-packing head, which distance approximates the diameter of a cantaloupe, when such fruit is being packed, since a first layer of fruit is already packed in the box. Thus, in a continuous packing operation as the present apparatus is capable of providing, each packing head is packing its respective layer of fruit simultaneously with the other packing head.

Box pushing means cooperate with the L-shaped table assembly to remove packed boxes to suitable conveyors while empty boxes may be introduced manually or by other suitable means. Simultaneously operating with the box pushing means, the fruit retaining means aforementioned is actuated to release more fruit from the feeders onto the respective packing heads to start another cycle of continuous and simultaneous operation.

Means for pivoting the packing heads and returning them to their original inclined position include pivotable members, roller guides or actuators, lever arm and chain means and the like, which cooperate with a linkage system.

The present machine provides several advantages over the apparatus disclosed in the cross-referenced patent application, now U.S. Pat. No. 4,203,274. For example, in that apparatus, a transfer rack is pivotally mounted to and carried by a movable carriage which is caused to advance downwardly towards the box to be packed. The transfer rack is provided with restraining pins and fingers to maintain the fruit in a prearranged pattern as well as preventing the fruit from falling from the rack while being advanced downwardly toward the box. Movement of the transfer rack and carriage is necessary to move the rack into engaging position with the box while concurrently actuating mechanism which tilts the rack to thereby empty the fruit into the box. Fruit oftentimes fall from the rack during its downward movement toward the box. If the restraining pins and fingers are repositioned or bent or otherwise manipulated to better retain fruit during this movement, the pins and/or fingers often impact the box to prevent proper packing, or otherwise pack the fruit not in accordance with prearranged patterns. Further, the apparatus required rails and associated carriages for movement thereon which increased size and cost of the machine, including mechanisms needed for providing this movement. Additionally, advancement and return of the rack consumed much valuable time.

The present invention overcomes these infirmities and provides a compact machine devoid of movable carriages with their associated mechanisms and yet rapidly and continuously packs layers of fruit in accordance with prearranged stacking patterns.

DETAILED DESCRIPTION OF THE INVENTION

Figure 1:
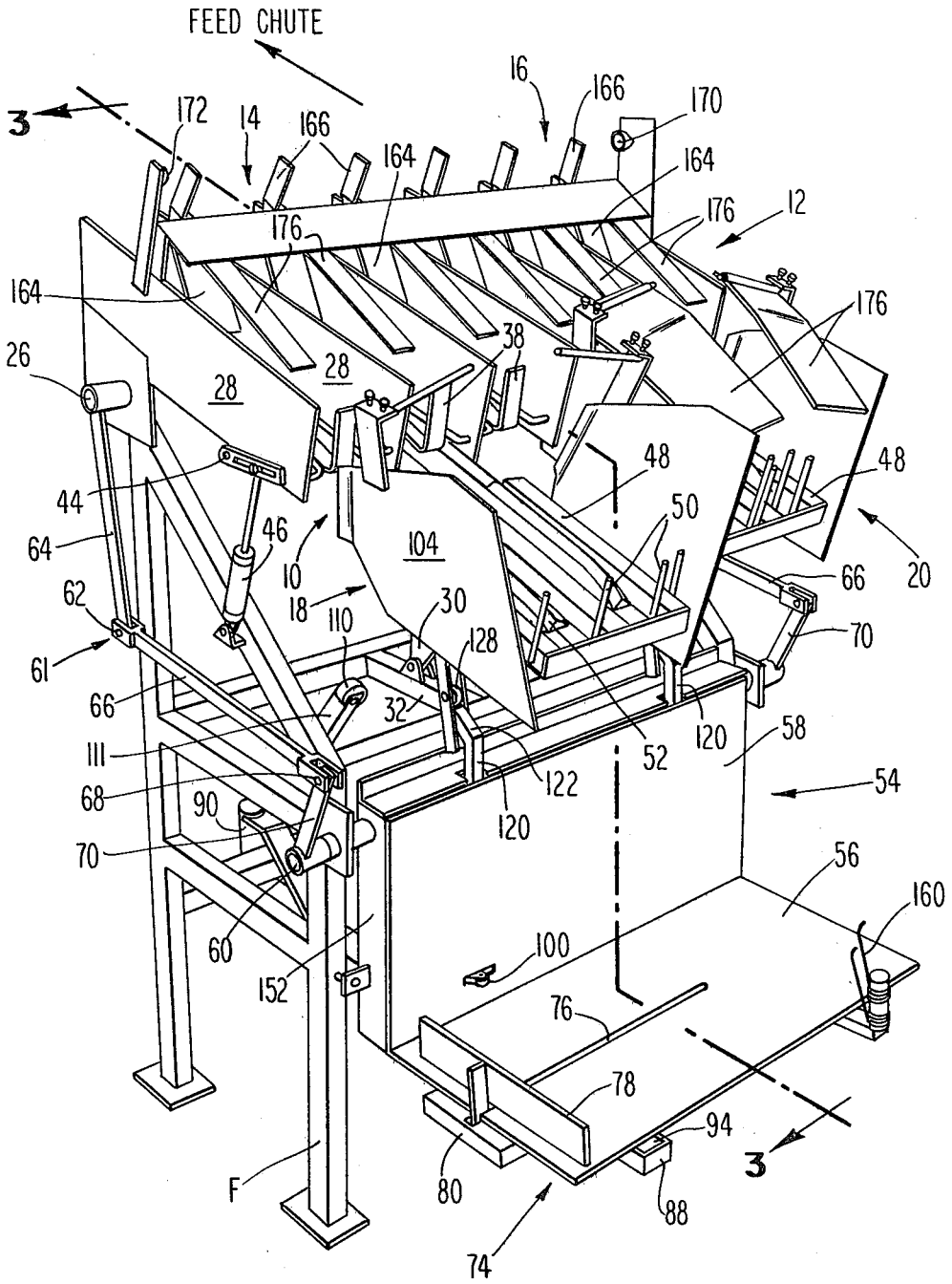
FIG. 1 is a perspective view of the present fruit packing machine, duplicate parts omitted for clarity.

The fruit packing machine of the present invention includes structure for simultaneously packing multiple layers of fruit, typically cantaloupes, into containers in nesting or complementary patterns. The machine is provided with a pair of inclined feeder-packing head assemblies 10 and 12, each respectively including a feeder 14 and 16, and packing head 18 and 20. Feeder-packing head assembly 10, also referred to hereinafter as the lower or longer feeder-packing head, is designed to pack a first or bottom layer of fruit FR into a box or container. Similarly, feeder-packing head assembly 12 may be referred to hereinafter as the upper or shorter feeder-packing head, and packs a top or second layer of fruit.

Both feeder-packing head assemblies are substantially identical, exceptions later noted, and perform identical operations concurrently in response to common or like mechanisms or actuators. The upper assembly is set back about 5" from the lower, or approximately the diameter of a cantaloupe when such fruit are being packed, in order to compensate for the presence of the bottom layer of fruit already packed in the container by the lower assembly. For the sake of clarity and brevity, description will proceed hereinafter of the lower feeder-packing head assembly 10 unless otherwise noted or distinguished.

The feeder-packing head assemblies are supported on suitable frame members F and are adapted thereon to receive fruit FR from an inclined feed chute (not shown). Feeder 14 comprises a pair of spaced elongated support members 24 (FIG. 4) preferably rectangular, secured to a plate 25 (FIG. 3) welded to shaft 26 journalled to frame F.

Vertical guide members 28, mounted for limited rotation with support members 24 about shaft 26, prevent fruit FR from leaving feeder 14 and insure that fruit from the feed chute are guided into three separate rows. Although three rows of fruit FR for each feeder are contemplated by the present invention, it is understood that any convenient number of rows may be employed, for cantaloupes or other type fruit to be packed, by merely adapting the structure herein described.

In "rest" position of the machine, or when the machine is idle, support members 24 are inclined about 15° from the horizontal. A single solenoid-operated air cylinder 30, mounted centrally on a frame member 32, rotates both feeder-packing head assemblies downwardly about 25°, or until an angle of about 40° from the horizontal is formed, by virtue of piston of air cylinder 30 articulating with a cross-member 34 welded across the inner support members 24 of each feeder-packing head assembly.

A fruit retainer 36 (FIG. 3) is mounted for 25° of rotation, i.e., between 15° and 40° from the horizontal, independently of movement of the feeder-packing head assembly to control flow of fruit to and from the feeder. Thus, fruit retainer 36 includes a lower retaining bar 38 and an upper retaining bar 40, and a connecting portion 42 therebetween. Each of the three rows of fruit is supported by and roll downwardly on support members 24 and connecting portion 42. Fruit retainer 36 is mounted for limited rotational motion on fruit retaining shaft 44 which is caused to rotate by solenoid-operated air cylinders 46 mounted to frame F. Of course, a similar air cylinder 46 is mounted to the other side of frame F for controlling a similar fruit retainer 36 for the upper feeder-packing head, both air cylinders 46 being simultaneously activated from a control box (not shown) through conventional circuitry and components not shown or described. Similarly, air hoses to the air cylinders already described and to be hereinafter discussed are not shown, it being understood that a pressure of about 100 psi is adequate.

Elongated support members 24 extend into packing head 18 which is provided with three tiltable support members 48, shorter in length than support members 24. Support members 24 are spaced in alternating relationship with support members 48 and are coplanar therewith when not in tilt position. Fruit retaining pins 50 extend upwardly from a forward or lower position of packing head 18. The positioning of pins 50 determine the staggered pattern of the fruit on the packing head, and hence the pattern of fruit of the bottom layer. Thus, two retaining pins 50 are disposed outwardly at the central portions of the packing head to cause the middle row of fruit to remain lower than the outer rows (FIG. 1). Packing head 20 of the upper feeder-packing head 12 will have retaining pins 50 so positioned to cause fruit on packing head 20 to be disposed in complementary or staggered relationship to the lower packing pattern. Lower ends of support members 24 are provided with raised portions or inverted V-portions 52 (FIG. 5) to further insure that fruit on the packing heads will form and retain three separate rows.

Packing head 18 cooperates with a tilt assembly, later described, which pivots or tilts the packing head about its lower portion to cause fruit thereon to be ejected therefrom into an oncoming packing box carried on and guided by an L-shaped table assembly. L-shaped table assembly 54 comprises a flat lower bed 56 and an upright member 58. Table assembly 54 is pivotable, later described, approximately 50° from vertical about a shaft 60, i.e., upright member 58 becomes aligned with the feeder-packing head assemblies when the latter are in their 40° positions aforediscussed. Shaft 60 rotates in response to rotation of shaft 26 through a linkage arrangement 61. Thus, upon rotation of shaft 26 in one direction, linkage arrangement 61, through pivot pin 62 interconnecting linking members 64 and 66; and pivot pin 68 interconnecting linking members 66 and 70, causes shaft 60 to rotate in the other direction, i.e., upright member 58 becomes aligned with the feeder-packing head assemblies, or 40° from horizontal. More specifically, by means of linking arrangement 61 on each side of the packing machine operating in unison, rotation of shaft 26 through an arc of about 25° in one direction produces about a 50° rotation of shaft 60 and the table assembly in an opposite direction.

Figure 11:
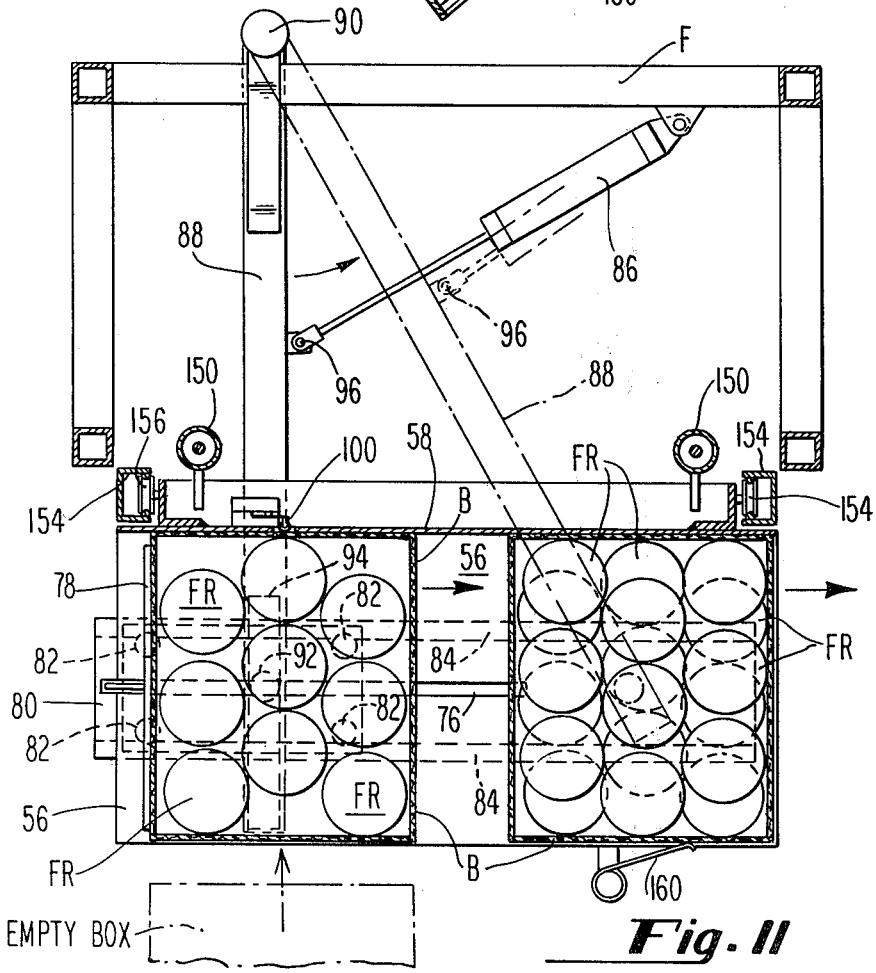
FIG. 11 is a cross-sectional view taken substantially along line 11—11 of FIG. 3, including boxes of fruit packed in accordance with the invention.

Flat bed 56 is provided with a box pushing mechanism 74 which functions to move box B in position to receive its top layer (FIG. 11). Bed 56 is provided with a slotted guideway 76 through which a pusher plate 78 is reciprocable by means of a carrier plate 80 attached therebelow and below bed 56, which carrier plate is provided with a double pair of roller wheels 82 (FIG. 3) mounted thereabove for rolling against rails 84 secured to an underportion of flat bed 56 of the table assembly. Rail 84 are disposed in parallel relationship to slotted guideway 76. Box pushing mechanism is actuated when air cylinder 86 (FIG. 11), suitably pivotally mounted to frame F, pivots arm 88 about pivot point 90 such that a guide roller 92 mounted below carrier plate 80 (FIGS. 2 and 3) engages channel 94 provided in arm 88. Piston rod of air cylinder 86 is pivotally mounted to arm 88 at 96. Pusher plate 78 returns to its original position when the piston rod of air cylinder 86 is returned to its original extended position. Fruit retainer 36 pivots downwardly to its 40° position simultaneously with actuation of the box pushing mechanism, later discussed. A spring (not shown) may be used to insure the complete return of pusher plate 78. It is understood that air cylinders aforedescribed, or to be hereinafter discussed, employ limit switches to either control the distance its piston rod is extended and retracted; or alternatively, the distance the structure to be controlled is permitted to move.

Upright member 58 of table assembly 54 carries a normally open limit switch 100. As a consequence thereof, the machine may be controlled such that, unless a box to be packed with fruit is in contact with switch 100, electric current in the control box will not flow. Under normal continuous operating conditions however, limit switch 100 will remain closed due to contact with the box being packed with a first layer or an unpacked box being pressed thereagainst.

Figure 5:
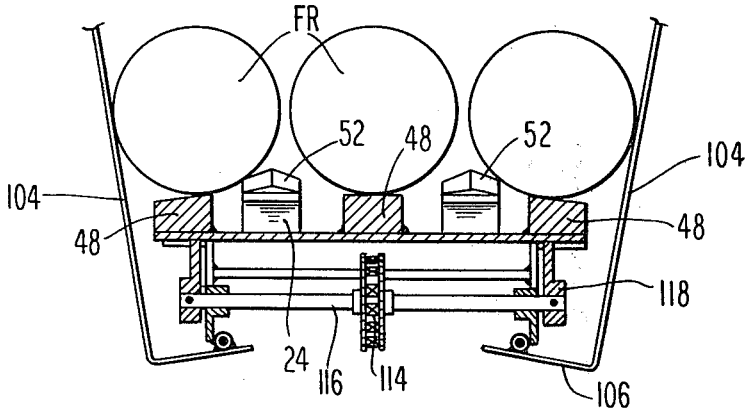
FIG. 5 is a cross-sectional view of the machine illustrated in FIG. 3 taken along line 5—5 thereof.
Figure 7:
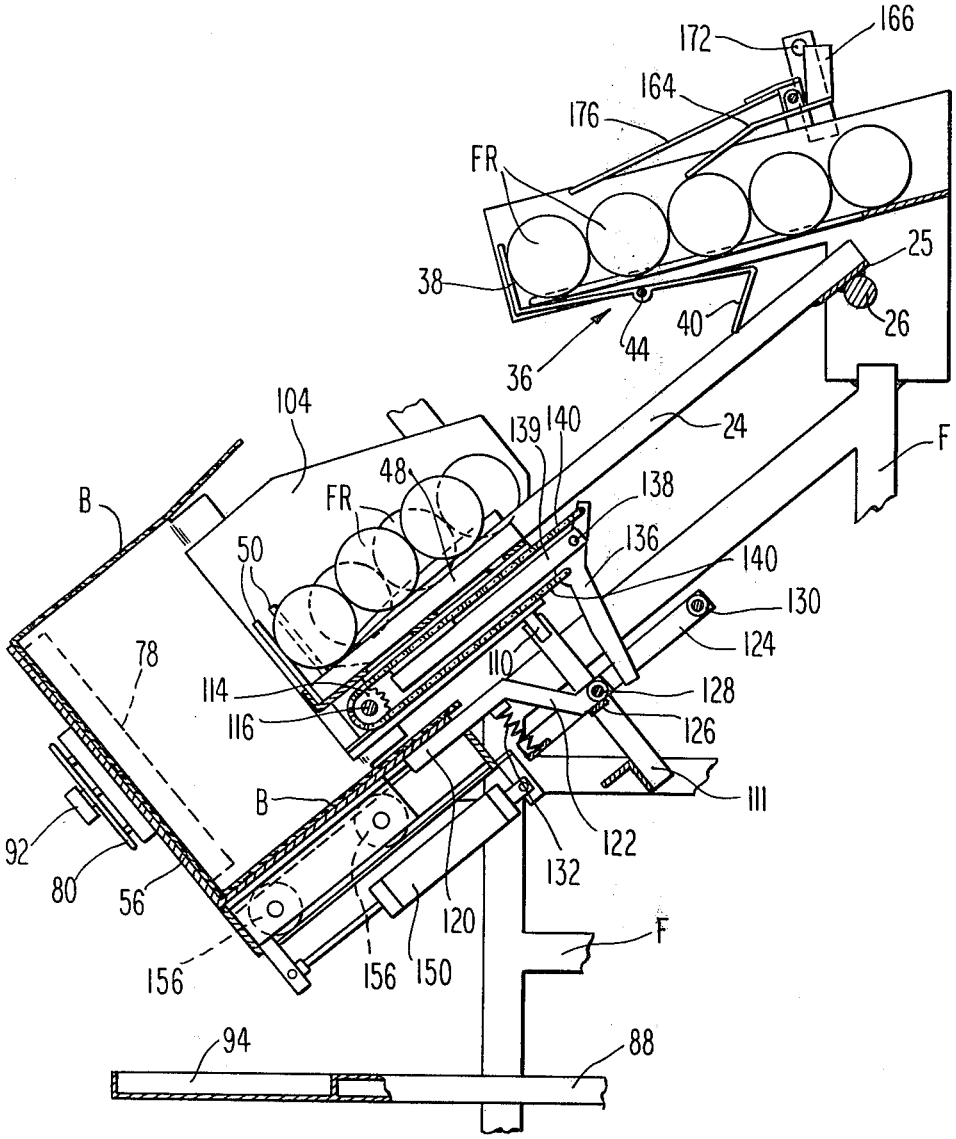
FIGS. 7, 8 and 9 are views similar to FIG. 3, structure omitted for clarity, illustrating sequential steps of operation of the present fruit packing machine.

Referring more particularly to FIGS. 5 and 7, packing head 18 is provided with pivotally mounted fruit guides 104 having lower members 106 which contact resilient wheels 110, suitably rubber, when the feeder-packing heads are rotated to their 40° position, or pre-packing position (FIG. 7). Wheels 110 are rotatably mounted to spring-mounted support members 111 which are secured to a suitable horizontal frame member. Thus, upon contact of wheels 110 with lower members 106, fruit guides 104 will fold or rotate inwardly on rods 108 to insure that fruit resting on packing head 18 is properly confined before being tilted to eject fruit into the packing box, later described. Fruit guides 104 for the upper packing head 20 are positioned accordingly. Means 112 are provided for adjustably controlling the angle of disposition of fruit guides 104.

Figure 6:
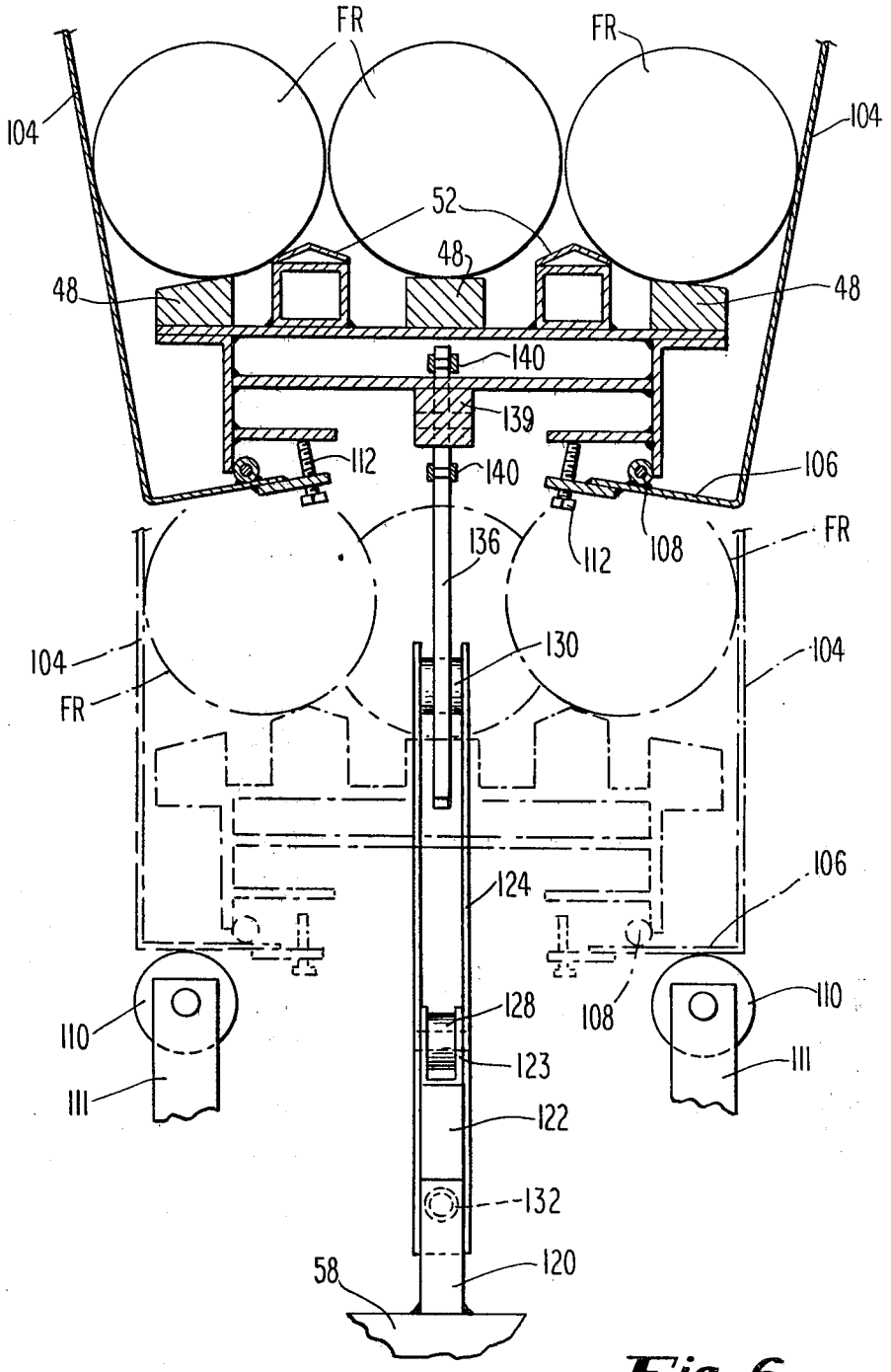
FIG. 6 is a view similar to FIG. 5, taken substantially along line 6—6 of FIG. 3, illustrating the fruit guides associated with the packing head assembly in their folded position when the machine assumes the position of FIG. 7.

Referring again to FIGS. 2, 3, and 6, and to FIGS. 7 through 10, tilt assembly means for tilting packing head 18 at a predetermined moment to eject fruit thereon in a prearranged pattern into an oncoming box B will now be described.

A sprocket 114 causes shaft 116 to rotate therewith, which shaft is secured in fixed relationship to support members 48 of packing head 18 through members 118 rigidly attached therebetween (FIG. 5). Thus, any rotation of sprocket 114 causes a similar rotation of the support members. Sprocket 114 is designed to be rotatable about 90°, or sufficiently to cause the support members of the packing head to tilt and eject its fruit.

A connecting bar 120 (FIG. 6) has its lower end welded along a central portion of upright member 58 of table assembly 54. Upper end of connecting bar 120 is provided with bend portions 122 and 123 (FIGS. 7–10). Bend 123 is bifurcated to receive a lower roller guide 128, which roller is rotatably mounted to fork 124. Another guide roller 130 is rotatably mounted within fork 124 at an upper portion thereof.

Articulation between support members 48 of packing head 18 and fork 124 is effected through an angled lever arm 136 which pivots about pivot pin 138 mounted to bar 139 secured conveniently to a support member 24. A chain 140 has its ends connected to angled lever arm 136 such that rotation thereof about pivot pin 138 causes sprocket 114 to rotate accordingly.

More specifically, when the present machine is idle, or in a "resting" position (FIG. 2), feeder-packing heads 10 and 12 and fruit retainers 36 form an angle of about 15° with the horizontal; table assembly 54 is at its lowermost position; and the tilt assembly assumes the position illustrated therein.

In the pre-packing position (illustrated in FIG. 7), packing head 18 of feeder-packing head 10, through main air cylinder 30, is rotated downwardly about 25° which simultaneously rotates table assembly 54 in an opposite direction about 50° through linkage arrangement 61. Connecting bar 120 is rigidly secured to upright member 58 of table assembly 54. Thus, rotation of member 58 and connecting bar 120 which articulates with fork 124, in conjunction with downward rotation of the packing head 18 of the feeder-packing head which carries angled lever arm 136, chain 140, and sprocket 114, results in the tilt assembly assuming the position illustrated in FIG. 7. It is noted that fruit retainer 36 remains stationary, i.e., lower retaining bars 38 are restraining fruit from entering packing head 18 while upper retaining bars 40 of fruit retainer 36 are passively disposed.

Figure 2:
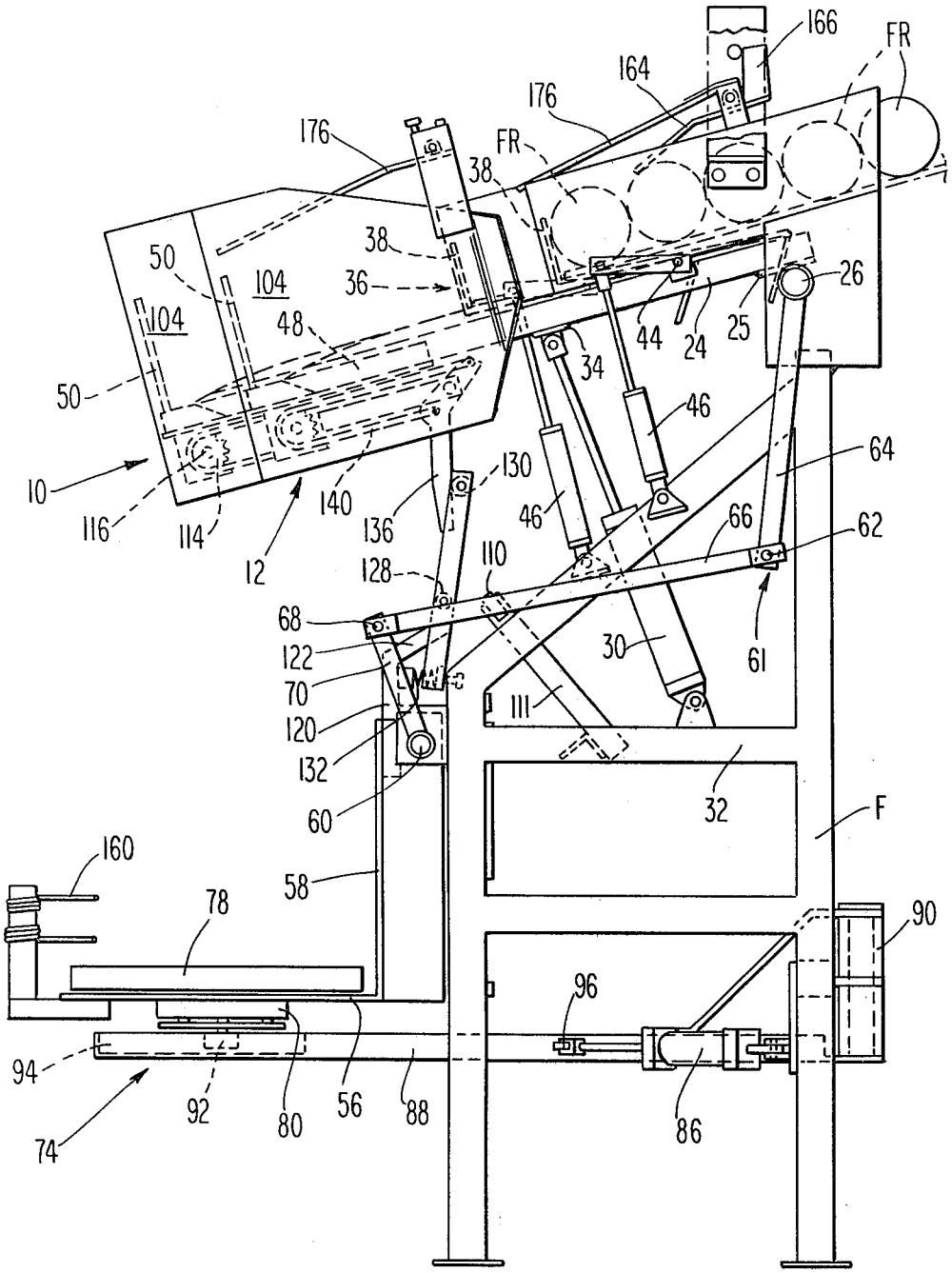
FIG. 2 is a side elevational view of the machine of FIG. 1 looking thereat from the right side thereof.

Lower members 106 of pivotally mounted fruit guides 104 contact wheels 110 when packing head 18 of feeder-packing head 10 is rotated downwardly to its 40° position to cause the guides 104 to fold inwardly to insure that fruit arranged on packing head 18 is properly confined before being ejected or packed into the packing box, as aforediscussed. Fruit guides 104 associated with the upper packing head will be set back about 5" (FIG. 2).

In the packing or tilt position of the machine (FIG. 8), table assembly 54 moves toward packing head 18 about 5" by means of a pair of air cylinders 150 mounted to frame F. A rectangular plate member 152 (FIG. 3) is welded to shaft 60 which rotates the table assembly. Plate member 152 is provided with channel guideways 154 (FIG. 11) which receive rollers 156 secured to upright member 58. Thus, rotation of shaft 60 through linkage arrangement 61 causes plate 152, as well as upright member 58 and table assembly 54, to rotate therewith. Now, actuation of solenoid-operated air cylinders 150 causes table assembly 54 to be moved upwardly toward packing head 18 about 5" as rollers 156 move upwardly within channel guideways 154.

Movement of table assembly 54 toward packing head 18 causes connecting bar 120 to move therewith. Movement of connecting bar 120 causes lower guide roller 128 to urge angled lever arm 136 upwardly for pivoting thereof about pivot point 138 which causes chain 140 to rotate sprocket 114 to thereby tilt packing head 18 such that fruit arranged thereon is ejected into the packing box advancing toward it in a layer having a pattern identical with the pattern arranged on said packing head.

Sequentially, air cylinders 150 then retract table assembly 54 to its pre-pack position, or down and away from the packing head, but not to its original rest position. Support members 48 remain in their tilt attitude as illustrated in the post-pack position of FIG. 9. Angled lever arm 136 is substantially quiescent during the retraction step. Fork 124 travels downwardly with connecting bar 120 connected to upright member 58. Angled lever arm 136 thus assumes the relative positioning shown in FIG. 9, i.e., in contact or close contact with upper roller guide 130.

Figure 3:
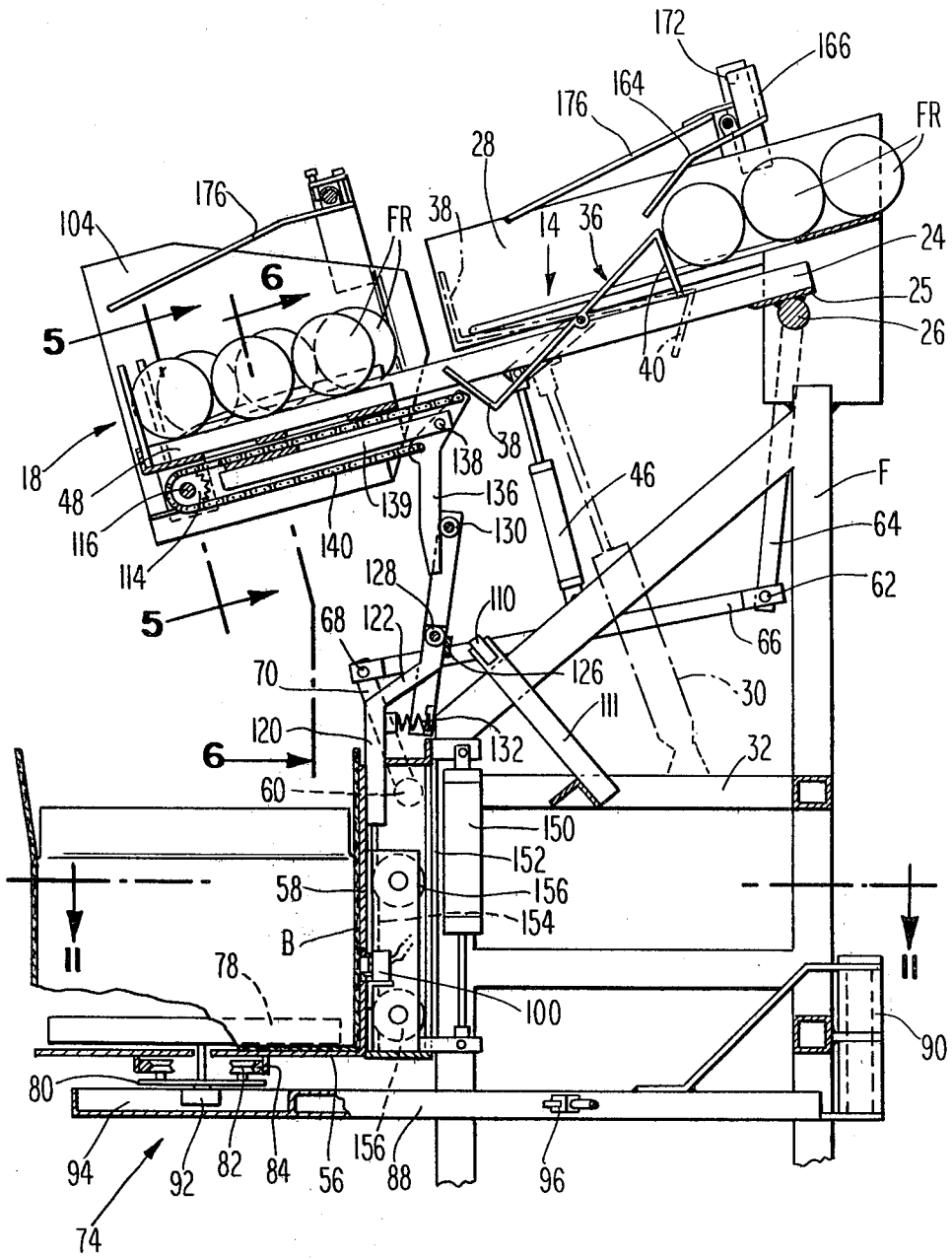
FIG. 3 is a cross-sectional view of the machine of FIG. 1 taken substantially along line 3—3 thereof.
Figure 4:
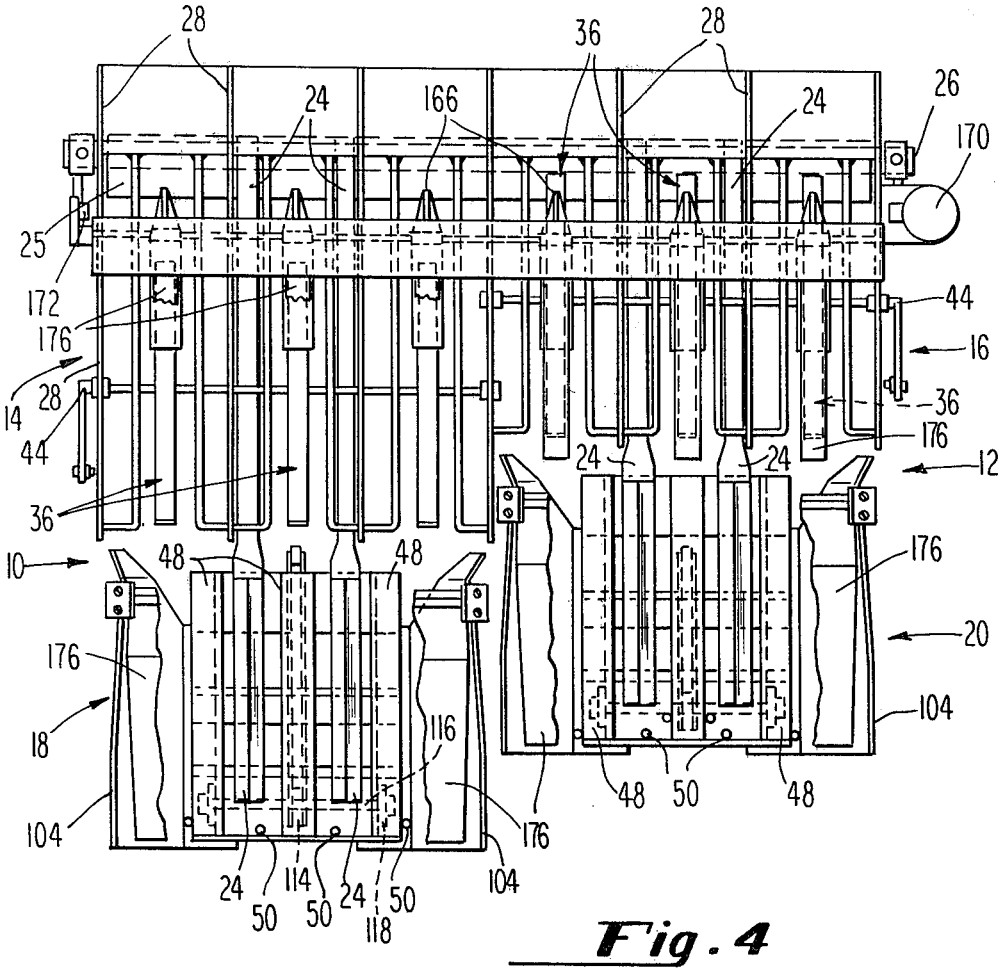
FIG. 4 is a plan view of the feeder-packing head assemblies of FIG. 1, parts omitted for clarity.

Table assembly 54 is now returned or rotated back to its rest position simultaneously with the return of feeder-packing head to its 15° position through linking arrangement 61 when main air cylinder 30 is actuated. Rotation or return of the table assembly back to its original or rest position causes upper roller guide 130 to pivot the angled lever arm 136 downwardly about pivot point 138 resulting in chain 140 rotating sprocket 114 in the other direction, i.e., to return support members 48 to their flat or untilted position (FIGS. 2 and 3). Of course, when feeder-packing head 10 is returned to its 15° position, lower members 106 of fruit guides 104 separate from wheels 110 to permit fruit guides 104 to swing outwardly once again.

Figure 8:
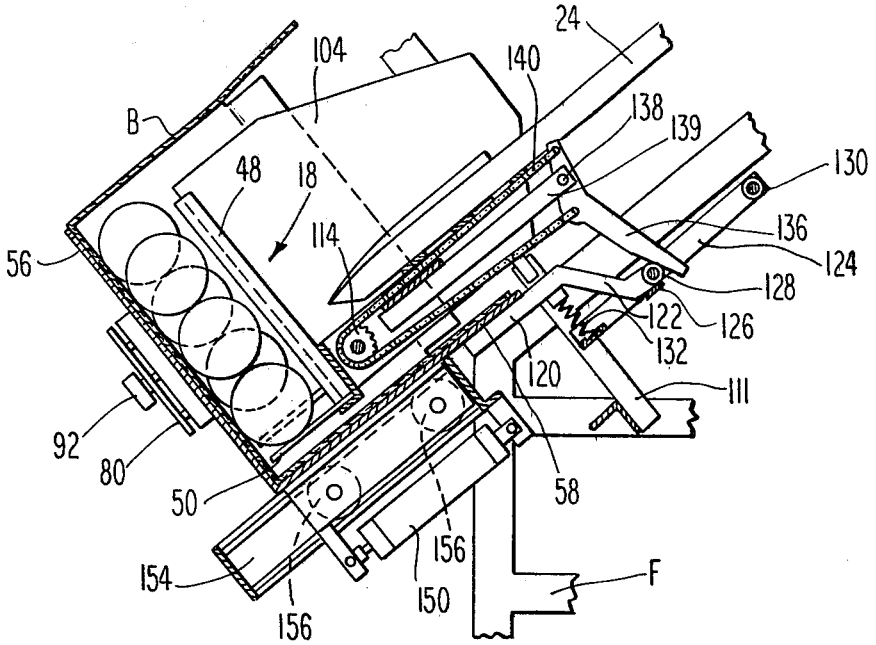
Figure 9:
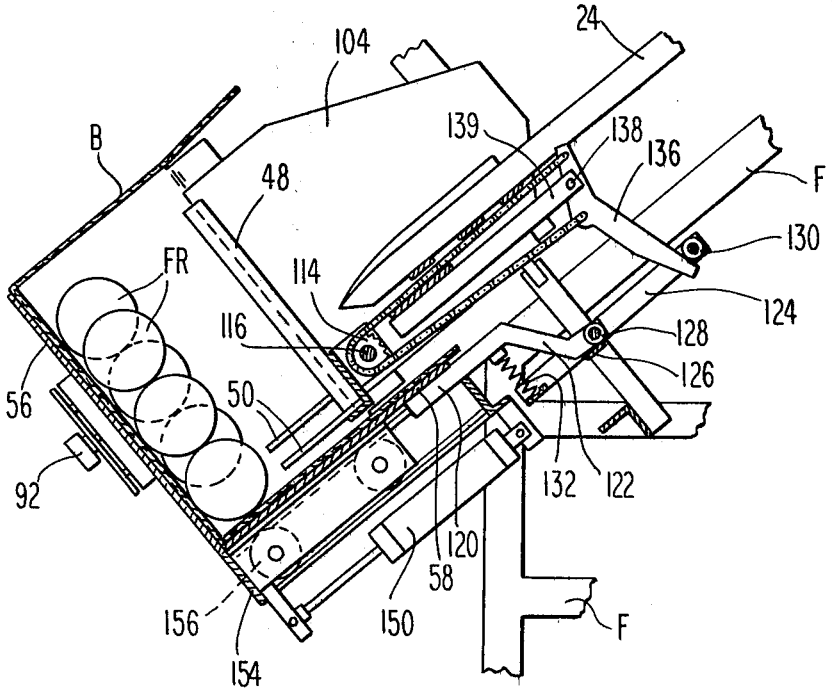
Figure 10:
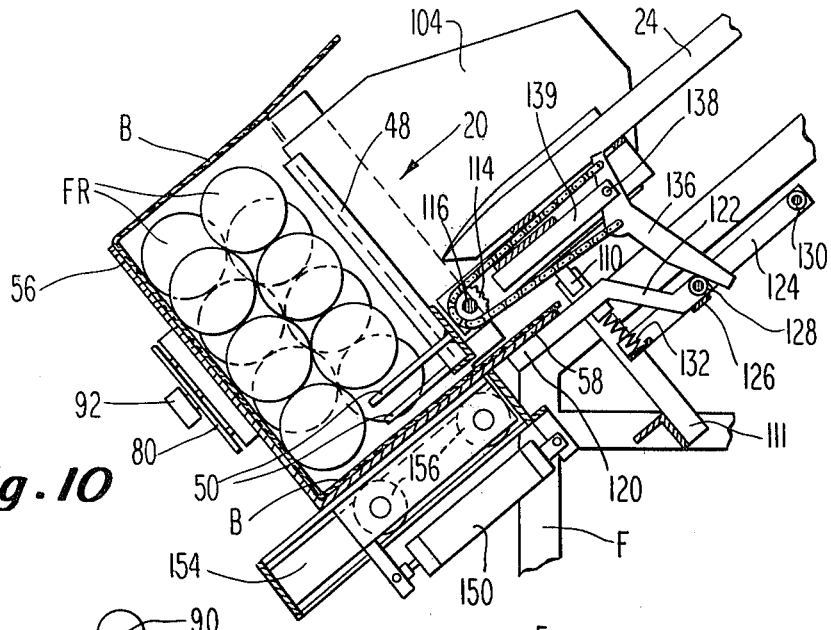
FIG. 10 is a view similar to FIG. 9, but illustrating the upper or shorter packing head assembly having packed a top layer of fruit.

A compression spring 132 is positioned between a lower portion of fork 124 and connecting bar 120 to urge these members apart to thereby insure that support members 48 of the packing heads are completely lowered, or substantially parallel with elongated support members 24 when the machine is at rest (FIG. 2) or whenever the packing heads are not in their tilt position to permit the unimpeded flow of the fruit thereon; and also to insure that lever arm 136 remains within the forked member 124 (FIGS. 7-9). A resilient stop member 126 may suitably be mounted at an outer portion of bend 122 to limit counterclockwise rotation (FIG. 7) of fork 124 due to action of spring 132. Stop member 126 is omitted from other drawings for the sake of clarity. It is understood of course that each packing head is tilted by nearly identical tilt assemblies, i.e., bars 139 and chains 140, for example, being shorter in the embodiment illustrated in FIG. 10 for the upper packing head assembly.

Next, box pushing mechanism 74 is actuated simultaneously with rotation of fruit retainer 36. Thus, packing box B (FIG. 11) is pushed into receiving alignment with upper packing head 20 and maintained thereat until a second layer is packed therein by means of spring-loaded box guide 160 mounted on flat lower bed 56. It must be borne in mind that the present fruit packing machine packs bottom and top layers of fruit into adjacent boxes simultaneously. To clarify, when box B, having bottom layer of fruit already packed therein is pushed into position to receive its top layer, another box which has already been packed with its top layer by upper packing head 20 will be pushed by box B onto suitable conveying means. The process is continuous. Of course, box B will, in turn, be replaced with an empty box (FIG. 11). Air cylinders 86 and 46 are actuated simultaneously through the control box to control the box pushing mechanism 74 and fruit retainer 36 respectively. In further clarification, fruit retainer 36 is rotated about 25° on fruit retaining shaft 44 (FIG. 3) when air cylinder 46 is actuated such that lower retaining bars 38, restraining fruit thereabove from entering packing head 18, now permit fruit to roll thereupon while upper retaining bars are swung into position to prevent fruit from entering feeder 14. Return of the box pushing mechanism to starting position by air cylinder 86 (FIG. 2) occurs simultaneously with rotation of fruit retainer 36 back to its original or resting position, i.e., fruit rolls onto feeder 14 but are prevented from entering packing head 18 by lower retainer bars 38. Of course, fruit are already arranged on both lower and upper packing heads in prearranged patterns from a prior cycle.

Pivoting flaps 164 (FIGS. 1,2,3, and 7) are provided above feeders 14 and 16. Each feeder is designed, as abovediscussed, to accommodate three rows of fruit for cantaloupe packing operation. A flap 164 is provided above each row. Each flap must be contacted by a cantaloupe passing from the inclined feed chute to the feeders. Each flap includes an upstanding ear 166 which is capable of interrupting continuous light beams emanating from a photocell 170 from striking a reflector 172 for reflection back into the photocell. Interruption of a beam by an ear 166 serves to terminate electric power to each of the solenoid-operated air cylinders to effectively shut down the machine and thus prevent fruit from being miscounted, misaligned, and the like. Under normal conditions, the steady flow of fruit into the feeders will cause ears 166 to remain clear of the light beams.

Pivoting hoods or debouncing flaps 176 may be installed over each packing head and/or feeder to prevent fruit from bouncing out or around.

We claim:

1. Apparatus including a supporting frame for packing objects into container means in a predetermined pattern comprising a first feeder and a second feeder adapted to receive said objects from a source, a first packing head and a second packing head in line with and downstream of said first feeder and second feeder respectively to receive said objects therefrom for arrangement thereon in said predetermined pattern, a table assembly below said packing heads for carrying and guiding said container means, means for simultaneously aligning said packing heads with said table assembly, means for tilting said aligned packing heads while simultaneously advancing said aligned table assembly toward said tilted packing heads to eject said objects therefrom into said container means, said first packing head ejecting said objects thereon into said container means to form a bottom layer therein in accordance with said predetermined pattern of said objects on said first packing head, and said second packing head, simultaneously with said first packing head, ejecting said objects thereon into container means already packed with a bottom layer from said first packing head as a top layer in accordance with said predetermined pattern of said objects on said second packing head, said top layer predetermined pattern of packed objects being complementary to and staggered with said bottom layer of packed objects.

2. The apparatus of claim 1 wherein said means for simultaneously aligning said first packing head with said table assembly simultaneously aligns said second packing head therewith.

3. The apparatus of claim 2 wherein fruit retaining means is mounted adjacent said feeders to control flow of objects from said source onto said feeders and to sequentially control flow of said objects from said feeders onto said packing heads.

4. The apparatus of claim 3 wherein said means for simultaneously aligning said packing heads with said table assembly comprises a first shaft and second shaft journalled for rotation in said supporting frame of said apparatus, said feeders and packing heads being limitedly rotatable on said first shaft, said table assembly being limitedly rotatable on said second shaft, a linking arrangement articulating between said first shaft and said second shaft whereby rotation of said first shaft in one direction causes rotation of said second shaft in an opposing direction.

5. The apparatus of claim 4 further characterized by said table assembly including an upright member and a lower flat bed, said table assembly comprising means for elevating said table assembly comprising a plate secured to said second shaft, roller means connected to said upright member, said plate having channel guideways provided at vertical edges thereof for receiving and guiding said rollers, solenoid-operated air cylinder for moving said rollers upwardly within said guideways whereby said table assembly is elevated to an object receiving position.

6. The apparatus of claim 5 wherein means for tilting each of said packing heads comprises a sprocket mounted to each of said packing heads for rotating said packing heads therewith, an angled lever arm pivotally mounted to each of said feeders, transmitting means connected between each of said angled lever arms and each of said sprockets, a pair of connecting bars secured to said upright member of said table assembly, a fork communicating between each of said connecting bars and each of said angled lever arms whereby elevation of said table assembly causes said angled lever arms to travel within said forks to pivot said angled lever arms for rotation of said transmitting means about said sprockets to thereby tilt each of said packing heads.

7. The apparatus of claim 6 further characterized by an upper roller guide and a lower roller guide mounted for rotation within each of said forks whereby said angled lever arms contact said roller guides for controlling pivoting of said angled lever arms.

8. The apparatus of claim 7 wherein said transmitting means is a chain.

9. The apparatus of claim 8 wherein a compression spring is mounted between each of said connecting bars and each of said forks to urge said forks against said angled lever arms to facilitate unimpeded flow of said objects from said feeders to said packing heads prior to said objects being arranged thereon in a predetermined pattern.

10. The apparatus of claim 9 wherein said lower flat bed of said table assembly carries container means pushing mechanism comprising a slotted guideway provided in said flat bed, a pusher plate above said flat bed adapted for reciprocal movement in said slotted guideway, said pusher plate including a plate attached thereto mounted below said flat bed and having a roller depending therefrom, a pivotable arm mounted to said frame, said pivotable arm having a channel therein for receiving said roller, and means for pivoting said pivotable arm whereby said roller causes said pusher plate to travel in said slotted guideway for pushing said container means.

11. The apparatus of claim 10 wherein said container means pushing mechanism is actuated simultaneously with said fruit retaining means.

12. The apparatus of claim 9 wherein said objects from said source contact flaps prior to being received by said feeders, a photocell and reflector therefor mounted above said feeders, said flaps having upstanding ears attached thereto for interrupting light beams emanating from said photocell when said flaps are not contacted by said objects to terminate flow of electric current in said apparatus to thereby shut down said apparatus to prevent miscounting and misalignment of said objects.

13. The apparatus of claim 9 further characterized by object guides having lower members, said object guides being pivotally mounted to said packing heads, resilient wheels means mounted to said supporting frame for contacting said lower members when said packing heads are simultaneously aligned with said table assembly to thereby pivot said fruit guides inwardly to insure objects arranged on said packing heads are properly confined prior to tilting thereof.

14. The apparatus of claim 4 wherein a 25° rotation of said first shaft causes a 50° rotation of said second shaft.

15. The apparatus of claim 1 wherein said objects include fruit such as melons and the like.

16. The apparatus of claim 1 wherein said second feeder and said second packing head are in coplanar and parallel juxtaposition with said first feeder and said first packing head, said second feeder and said second packing head being set back from said first feeder and said first packing head a distance approximating the diameter of said objects being packed.

* * * * *